US005546095A

United States Patent [19]

Lopez

[11] Patent Number: 5,546,095

[45] Date of Patent: Aug. 13, 1996

[54] NON-IMAGING GLIDESLOPE ANTENNA SYSTEMS

[76] Inventor: Alfred R. Lopez, Four Sarina Dr., Commack, N.Y. 11725

[21] Appl. No.: 252,756

[22] Filed: Jun. 2, 1994

[51] Int. Cl.[6] ..... H01Q 3/30; H01Q 21/10

[52] U.S. Cl. ..... 343/703; 343/816; 343/817; 343/890; 343/853; 342/373

[58] Field of Search ..... 343/800, 853, 343/844, 890, 891, 703, 816, 817; 342/410, 373; H01Q 3/00, 3/26, 3/30, 21/00, 21/10

[56] References Cited

U.S. PATENT DOCUMENTS

| | | | |
|---|---|---|---|
| 3,124,802 | 3/1964 | Dall'armi | 343/853 |
| 3,903,524 | 9/1975 | Giannini | 343/853 |
| 3,964,067 | 6/1976 | Lucas | 343/853 |
| 4,342,997 | 8/1982 | Evans | 343/853 |
| 4,823,144 | 4/1989 | Guy | 343/853 |

*Primary Examiner*—Michael C. Wimer
*Attorney, Agent, or Firm*—Kenneth P. Robinson

[57] ABSTRACT

A non-imaging antenna system for the Instrument Landing System (ILS) utilizes a spatial filter network to provide a glideslope beam at a positive angle, while providing a null effect at a corresponding negative angle to reduce energy reflection at the glideslope angle. Four radiating elements, each including dipoles and a corner reflector, can be used as two overlapping vertical arrays of three elements each. A magic-T input junction is used to provide sum and difference glideslope beam signals to the overlapping arrays. The radiated signals of the two overlapping arrays provide aircraft guidance signals enabling an approaching aircraft to derive indications of high or low departures from the desired glide path. The array apertures may also be tilted from vertical to avoid coning effects of prior ILS antennas. Guidance signals compatible with the current ILS are provided, while avoiding site limitations, snow cover and other operating deficiencies of prior ILS antennas.

23 Claims, 8 Drawing Sheets

NON-IMAGING GLIDESLOPE ANTENNA SYSTEMS

This invention relates to antenna systems and more specifically to antenna systems, using spatial filter networks in combination With overlapping vertical arrays of radiating elements, which are particularly applicable to providing glideslope signals for aircraft landing operations.

BACKGROUND OF THE INVENTION

The Instrument Landing System (ILS) is a standard type of aircraft landing system currently installed at many airports around the world. The ILS includes an antenna system arranged to provide glideslope signals radiated from a point near an aircraft runway toward an aircraft approach direction at an angle representing a desired glideslope angle for aircraft approaching the runway for landings. The glideslope angle, relative to a horizontal reference, is typically 3 degrees and the radiated glideslope signals typically include vertical guidance information which is detected by equipment aboard the aircraft to provide an indication to the pilot when the aircraft departs from the desired glide path. An aircraft can depart from the desired glide path by being too high (e.g., above the inclined center line of the radiated beam pattern) or too low (e.g., below such center line).

Existing types of ILS glideslope antennas provide a radiated beam pattern which is the composite of two portions of a radiated antenna pattern. These two portions are a direct radiated portion and a reflected portion. The actual radiated beam pattern is the resultant of adding the reflected portion to the direct radiated portion. Thus, in order to provide a 3 degree glideslope beam pattern, such existing ILS antennas radiate an antenna pattern which has closely equivalent radiated power at both +3 degrees and −3 degrees. Then, with reliance upon uniform reflection from the surface of the earth, the energy radiated at −3 degrees is reflected and additively combined with the energy radiated at +3 degrees. This prior form of ILS antenna utilizes horizontal polarization which provides an earth image that is very close to unity in relative amplitude with a 180 degree phase reversal, under ideal conditions. The ILS system depends upon the combination of the respective direct and reflected signals to provide the desired vertical guidance information. Consequently, the image (reflected) radiation is fundamental to the integrity of the guidance signal, which necessitates that provision must be made in order to monitor both the direct and the reflected signals on a continuing basis to ensure that a reliable guidance signal is provided.

Three basic problems are relevant to existing types of "imaging" glideslope antennas (i.e., antennas directly dependent upon the reliable presence of both direct and reflected signals to provide guidance signals). First, in installation of the antenna a substantially flat, open ground area must exist or be provided forward of the antenna in order to provide adequate, effective and uniform signal reflection. Second, under certain snow conditions (which are normally relatively rare) the image signal strength may be substantially reduced, so that its amplitude is much less than that of the direct signal. This situation could degrade or compromise the integrity of the guidance signal. Third, the image component of the guidance signal is difficult to monitor to insure continuing system integrity of operation. Monitors, for receiving image signal samples, which are located close to the glideslope antenna are not accurate. For accuracy, monitors must be located far from the glide path and are difficult to implement.

Objects of the present invention are, therefore, to provide new and improved glideslope antenna systems which avoid one or more of the disadvantages of prior antenna systems.

Additional objects are to provide new forms of non-imaging antennas which are particularly suitable for use in providing glideslope signals for aircraft landing operations.

SUMMARY OF THE INVENTION

In accordance with the invention, a non-imaging glideslope antenna system, for providing an aircraft guidance glideslope signal at a positive angle and a low signal effect at a negative angle relative to a horizontal reference, includes the following. A plurality of radiating elements are arranged for use in overlapping first and second vertical arrays, each of the vertical arrays including at least one radiating element also included in the other array and at least one radiating element not included in the other array. A signal distribution network is coupled between the first and second feed ports and the radiating elements, and arranged:

(A) to couple an upper array glideslope signal from the first feed port to the radiating elements of the first vertical array with signal amplitudes and phases effective to provide the low signal effect at the negative angle; and (B) to couple a lower array glideslope signal from the second feed port to the radiating elements of the second vertical array with signal amplitudes and phases effective to provide the low signal effect at the negative angle; and a signal input unit is coupled to the first and second feed ports, and arranged to provide the upper array glideslope signal to the first feed port and the lower array glideslope signal to the second feed port.

More particularly, the signal input unit may include a junction device, such as a magic-T junction, having sum and difference input ports to which carrier/sideband signals and sideband only signals are respectively supplied, in order to provide the desired upper and lower glideslope signals to the respective first and second feed ports of the signal distribution network.

For a better understanding of the invention, together with other and further objects, reference is made to the accompanying drawings and the scope of the invention will be pointed out in the accompanying claims.

DESCRIPTION OF THE INVENTION

Figure 1:
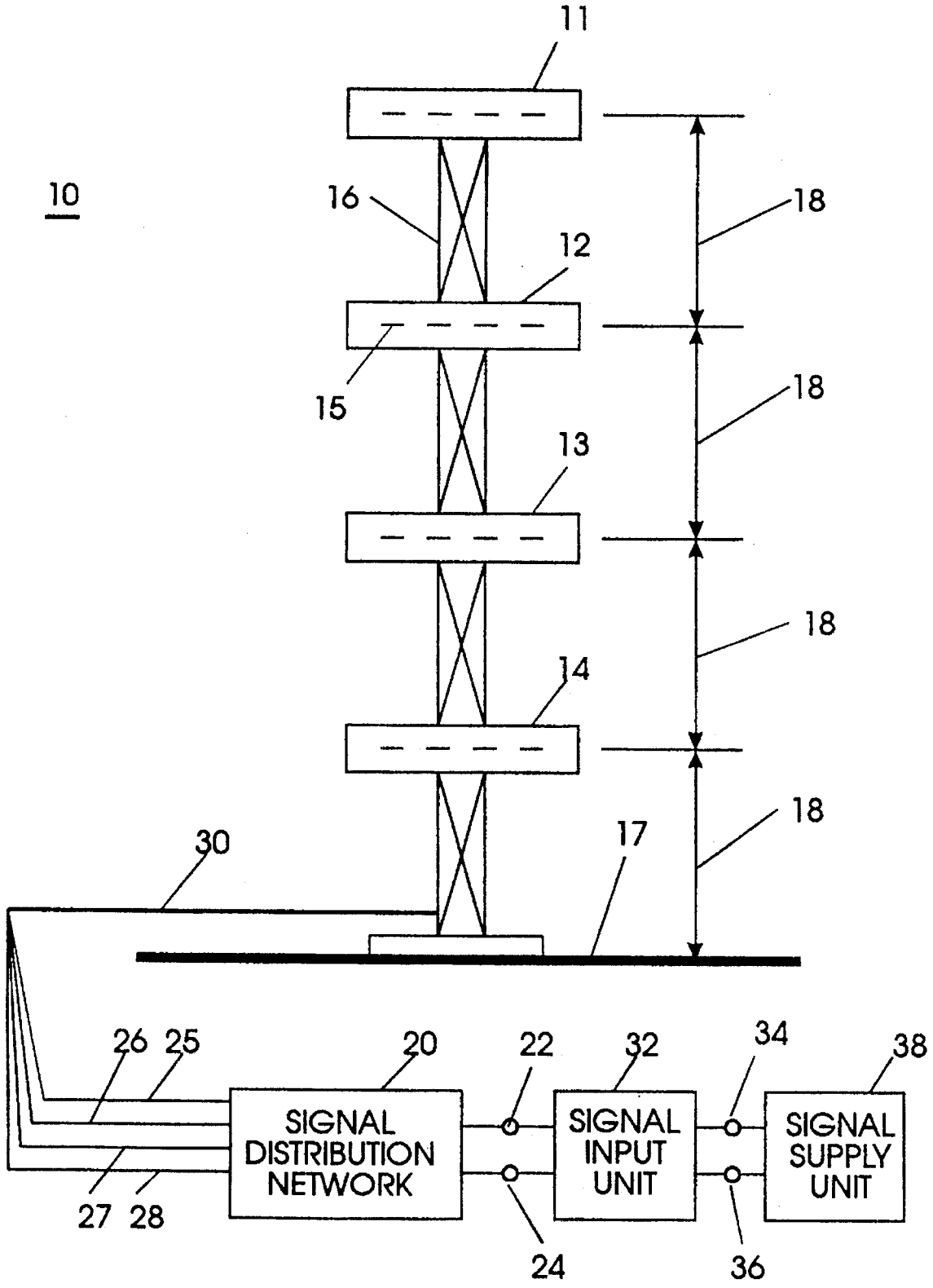
FIG. 1 illustrates, partially in block form, an embodiment of a non-imaging glideslope antenna system in accordance with the invention.

With reference to FIG. 1, there is illustrated partially in block form an example of a non-imaging glideslope antenna system in accordance with the invention. As shown, the antenna system includes an antenna assembly 10 comprising a plurality of radiating elements 11, 12, 13 and 14, each of which may comprise a horizontally-spaced plurality of horizontally polarized dipoles positioned in front of a suitable corner reflector. A typical dipole is indicated at 15. Specific forms of radiating element configurations are well known and, once having an understanding of the invention, skilled persons will be capable of providing a variety of types and forms of radiating element arrangements suitable for particular implementations. In FIG. 1, radiating elements 11–14 are shown supported by a structural, ground-mounted tower 16, with the elements spaced from each other and the ground 17 by an incremental distance 18, nominally equal to 9 feet in this example. For present purposes, "nominally" is used to indicate that a stated value may vary by about plus or minus 20 percent in a particular design or application of the invention. Forms of radiating elements used in existing ILS imaging antenna systems may be suitable for direct or modified application for use in antenna systems employing the invention.

As will be described further, radiating elements 11–14 are employed in the context of overlapping first and second vertical arrays, the first array in this example consisting of elements 11–13 and the second consisting of elements 12–14. It will thus be seen that each array includes at least one radiating element also included in the other array (here, both of elements 12 and 13 are common) and at least one radiating element not included in the other array (elements 11 and 14, respectively). The term "vertical array" is used to indicate that radiating elements are spaced vertically, although not necessarily positioned along a vertical axis, as will be discussed below.

The FIG. 1 antenna system also includes a signal distribution network 20 coupled between first and second feed ports 22 and 24 and the radiating elements 11–14. As shown, distribution network 20 is coupled to the antenna elements via four signal paths 25–28, which proceed to the tower 14 via cable 30. As will be described in greater detail with reference to FIG. 2, network 20 is arranged to couple an upper array glideslope signal from first feed port 22 to radiating elements 11–13 of the first vertical array and a lower array glideslope signal from second feed port 24 to radiating elements 12–14.

Signal input unit 32, as shown in FIG. 1, is arranged to provide the upper array glideslope signal to first feed port 22 and the lower array glideslope signal to second feed port 24. In a preferred embodiment, signal input unit 32 may take the form of a known type of magic-T junction having a sum input port, shown as input port 34, to which carrier and sideband signals are supplied and a difference input port, shown as input port 36, to which only sideband signals are supplied. As illustrated, the FIG. 1 system may also include signal supply unit 38 arranged to supply the desired carrier and sideband signals to input ports 34 and 36. As will be described, adjustment of the power of the sideband signals relative to the carrier power is effective to adjust the displacement sensitivity of the radiated guidance signal relative to aircraft spacing from the desired glideslope path.

Figure 2:
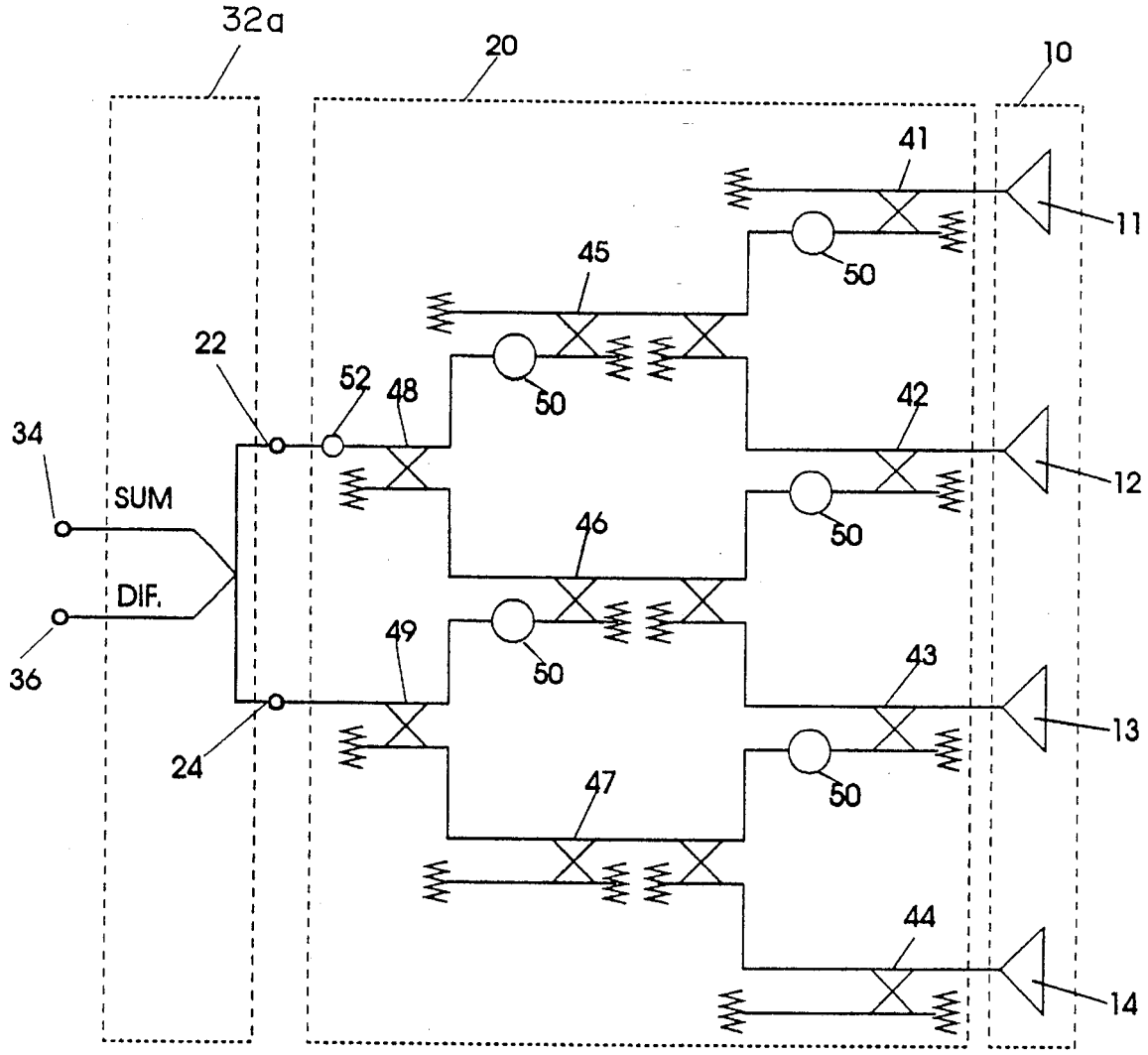
FIG. 2 shows portions of the FIG. 1 antenna system in greater detail.

Referring now to FIG. 2, certain aspects of an antenna system in accordance with the invention will be described in greater detail. Non-imaging glideslope antennas employing the invention are arranged to avoid the prior dependence on reflected signals by providing the desired aircraft guidance glideslope signal at a positive angle (i.e., the glideslope angle) while providing a low signal effect (e.g., an antenna pattern null) at a negative angle, relative to a horizontal reference such as the horizon.

As shown, signal distribution network 20 is coupled between the first and second feed ports 22 and 24 and the four radiating elements 11–14 of antenna assembly 10. In the FIG. 2 embodiment, network 20 comprises basically a combination of directional couplers and phase delay devices, with equalized line lengths of interconnecting transmission lines, so that line lengths to each of radiating elements 11–14 are substantially the same. In this configuration, a first group of four directional couplers 41–44 are individually connected to the radiating elements 11–14. A second group of three directional couplers 45–47 (each consisting of a series combination of two directional coupler elements) are individually connected between adjacent pairs of the first group 41–44, and a third group of two directional couplers 48 and 49 are individually connected between adjacent pairs of the second group 45–47. Each of directional couplers 41–44, 48 and 49 and each of the directional coupler elements in directional couplers 45–47 are 3 dB couplers, in a preferred embodiment. With this configuration and ignoring signal dissipation inherent in use of directional couplers, a signal coupled to feed port 22 will be provided to the radiating elements in the following relative signal amplitudes: element 11—one-quarter; element 14—one-half; element 13—one-quarter; element 14—no signal. This signal distribution follows from the well-known signal division characteristics of such directional couplers. Associated signal dissipation is addressed as an antenna design consideration concerning the level of signal power to be provided in order to achieve a desired level of radiated signals. Correspondingly, a signal coupled to feed port 24 will result in the following relative signal amplitudes at the radiating elements: element 11—no signal; element 12—one-quarter; element 13—one half; element 14—one-quarter. In accordance with well established beam forming techniques, supplying signals simultaneously to feed ports 22 and 24 is effective to provide a composite radiated antenna pattern having dual beam characteristics provided by the two overlapping arrays formed respectively by radiating elements 11–13 and 12–14. As will be appreciated, while the beam centers are 9 feet apart in this example, for an aircraft a distance away the beam center separation is negligible.

Figure 3:
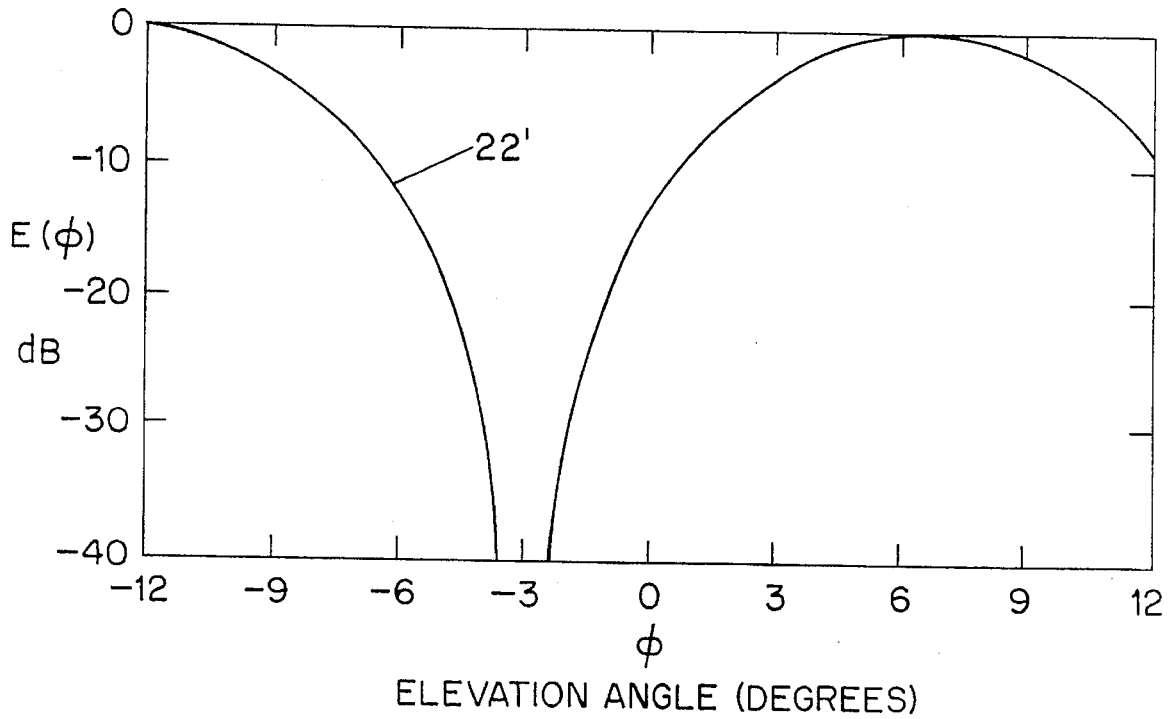
FIG. 3 is a representation of the free space antenna pattern for each three element array of FIG. 1.

In addition to the relative signal amplitudes effected by the directional couplers 41–49, the signal distribution network 20 is arranged, by relative phase delays, to provide signal phases effective to provide the low signal effect at a negative angle in accordance with the invention. As shown in FIG. 2, a delay unit 50 is included in the lower input signal path of each of directional couplers 41, 42, 43, 45 and 46. An additional delay unit 52 is included in the path from input port 22. As will be discussed further, this configuration of network 20 provides a spatial filter effect resulting in the desired negative angle low signal effect in the form of a radiation pattern null characteristic. More specifically, in the general case of a +3 degree glideslope beam and a substantially flat horizontal ground area extending in front of the antenna, the basic radiation pattern null of interest desirably extends from the antenna at a −3 degree angle. A corresponding radiation pattern 22' is illustrated in FIG. 3. FIG. 3 is a representation of the free space radiation pattern of each of the three element arrays 11–13 and 12–14, individually, shown independently of earth reflection effects. In an embodiment to provide a radiation pattern of the form illustrated in FIG. 3, the delay units 50 of FIG. 2 were arranged to each provide a nominal 123.5 degree phase delay and delay unit 52 was arranged to provide a nominal 56.6 degree phase delay. As will be understood, in antenna system implementations it is usual to adjust final values in order to adjust or optimize operational performance. In implementation of the FIG. 2 embodiment of the invention, the phase delay value utilized for delay devices 50, which may be any suitable devices for providing a fixed phase delay at the signal frequencies involved, is computed as follows:

$$\psi_{50}=180+360(d/\lambda)\sin(\alpha)$$

where d=vertical distance between radiating elements $\lambda$=free space wavelength $\alpha$=negative glide path angle For example, if d=9 feet, $\lambda$=3 feet and $\alpha$=−3 degrees then $\psi_{50}$=123.5 degrees.

Similarly, the phase delay value utilized for delay device 52 in FIG. 2 is computed as follows:

$$\psi_{52}=360(d/\lambda)\sin(\Phi)$$

where $\Phi$=elevation angle

For example, if d=9 feet, $\lambda$=3 feet and $\Phi$=3 degrees then $\psi_{52}$=56.5 degrees.

The preceding assumes a reflective earth aligned with the horizon, so that the downward null is desirably provided at the negative of the glide path angle (e.g., a −3 degree null direction for a +3 degree glideslope). If the earth profile forward of the antenna is such as to require an earth reflection at a different angle in order to result in alignment with the +3 degree glideslope beam center, then the $\alpha$ angle in the first formula given above is adjusted correspondingly. For example, if signals radiated at −5 degrees are reflected so the −5 degree signal after reflection radiates at a +3 degree angle relative to the antenna, $\alpha$ is changed to 5 degrees and results in a $\psi_{50}$ phase delay value of 85.8 degrees. The −5 degree reflection angle will then result in alignment of the negative angle null with the positive glideslope beam. These and other antenna design calculations and variations can be provided by skilled persons having an understanding of the invention.

With further reference to FIG. 2, the antenna system as illustrated also includes signal input unit 32. As shown, unit 32 is provided in the form of a magic-T junction **32*a*, which is a well known type of device commonly used in antenna applications. In FIG. 2, junction device 32*a* is a four port device, with sum and difference ports 34 and 36, respectively, used as input ports and having the two remaining ports used as output ports connected to the first and second feed ports 22 and 24, respectively of signal distribution network 20. In operation, carrier and sideband signals supplied to sum input port 34 and sideband only signals supplied to difference input port 36 are effective to provide the upper array glideslope signal and lower array glideslope signal, as appropriate for operation of the system, to the first and second feed ports 22 and 24**, respectively.

Operation

In overview, the invention enables provision of a non-imaging glideslope antenna system for ILS applications consisting basically of two overlapping vertical line arrays of horizontally polarized radiating elements, a signal distribution network and a magic-T junction signal input device. The junction device **32*a* is arranged to accomplish the provision of upper array glideslope and lower array glideslope signal feeds for development of a modulated guidance signal meeting current ILS operational standards. The signal distribution network 20 is configured to provide spatial filter operation effective to produce a low signal null effect which suppresses signal radiation in the direction of earth reflections of interest. Such null effect signal suppression at an angle such as −3 degrees is a radiation pattern effect provided equally for signals radiated by the upper array of elements 11–13 and the lower array of elements 12–14**. The radiation pattern null effects are provided without distorting the desired radiated glideslope guidance signal, which is not dependent upon an earth reflected image signal and is substantially independent of changes in earth reflection characteristics as may result from snow cover.

Figure 4:
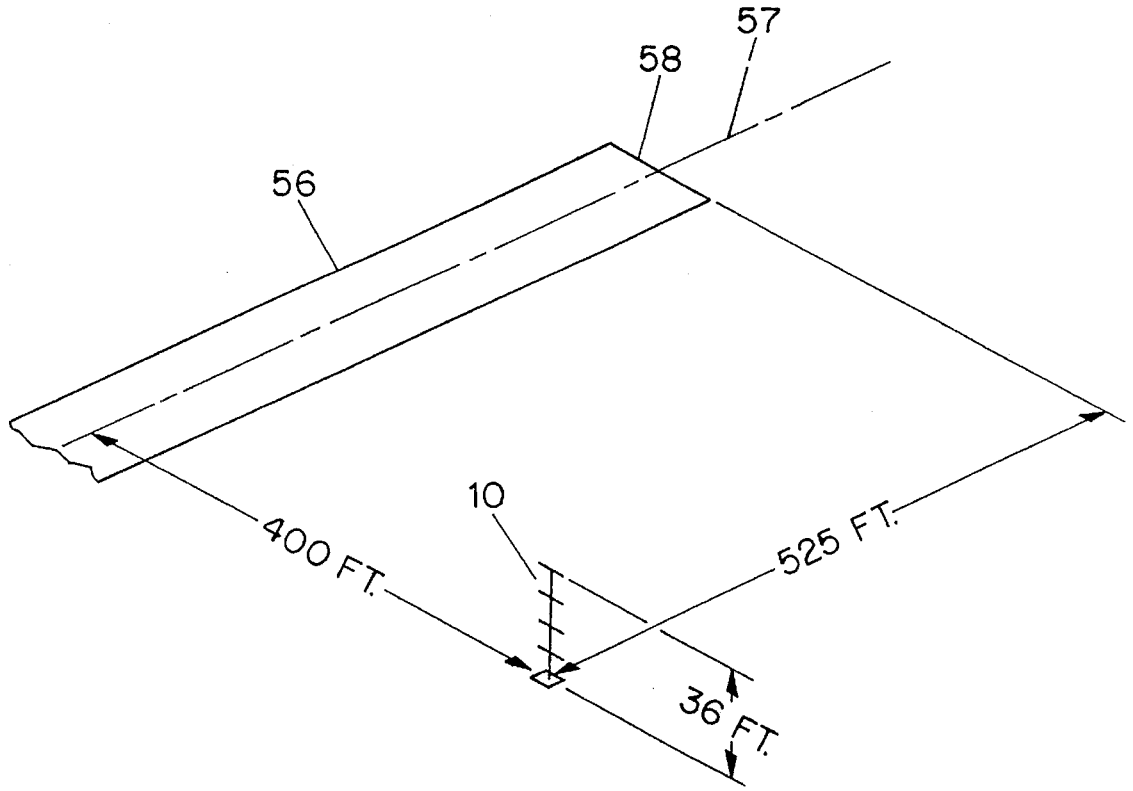
FIG. 4 shows a typical airport installation of the FIG. 1 antenna system.
Figure 5A:
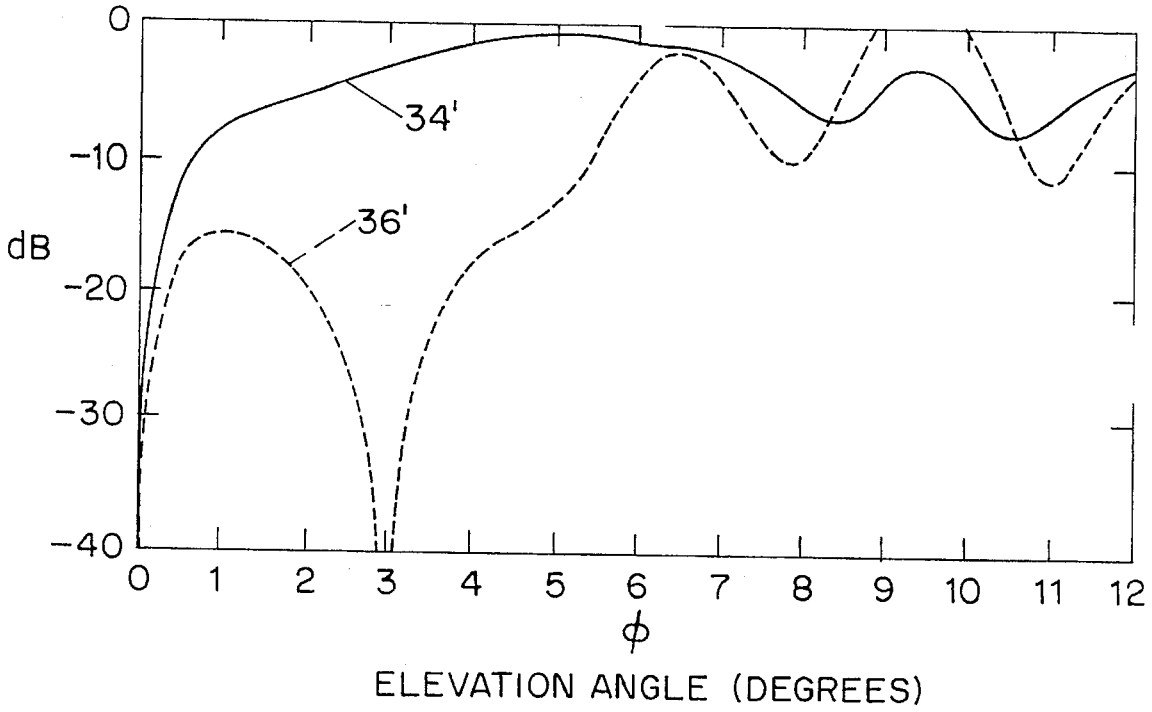
FIG. 5A is a representation of installed radiation patterns and FIG. 5B shows Differential Depth of Modulation versus elevation angle.

FIG. 4 shows details of an example of installation of an antenna system utilizing the invention at an airport. As shown, antenna assembly 10 is located to provide vertical guidance for an aircraft approaching on a glide path that intercepts the runway 56 along centerline 57 at a point (not shown) 1,000 feet from the runway threshold 58. Antenna assembly 10 may be of the type shown in FIG. 1, which has an overall height of less than 40 feet. Different vertical spacings of the radiating elements may be utilized, however overall antenna height is generally constrained by airport siting limitations. Performance of the FIG. 2 antenna system in an installed environment, as determined by computer analysis, is provided in FIGS. 5A and 5B. FIG. 5A shows computer generated amplitude (in dB) versus elevation angle (in degrees) data for the sum pattern 34' and the difference pattern 36' for the antenna installed above an earth with a relative dielectric constant of 20 and a loss tangent of 0.1. Sum pattern 34' represents the radiation pattern provided by the FIG. 2 system relative to sum input port 34 and difference pattern 36' correspondingly represents the radiation pattern relative to difference input port 36. To provide the required ILS guidance signal format the carrier and sidebands, offset from the carrier by 90 Hz and 150 Hz, are transmitted from the sum input port 34. The relative voltage amplitude of the sidebands with respect to the carrier is 0.40. The sidebands only are transmitted from the difference input port 36, with a 180 degree phase reversal of the 90 Hz sideband below the glide path provided by the properties of the difference signal. The composite radiated guidance signal has a predominance of the 90 Hz sideband above the glide path, as a result of the positive combination of the sum and difference sideband portions, and a predominance of the 150 Hz sideband below the glide path. The differential depth of modulation (DDM) is defined as the amplitude of the 150 Hz sideband divided by the amplitude of the carrier, minus the amplitude of the 90 Hz sideband divided by the amplitude of the carrier. The ILS guidance signal format requires that the DDM=0 and the slope of the DDM versus elevation angle have a nominal value of −0.25 DDM/degree on the glide path. The equation for the slope is given by:

$$\frac{d}{d\phi}\,DDM(\phi)=-\frac{2\pi Ad}{\lambda}$$

where

A=Difference mode amplitude relative to carrier amplitude d=Array element spacing (9 feet), and Φ=Elevation angle (radians)

Figure 5B:
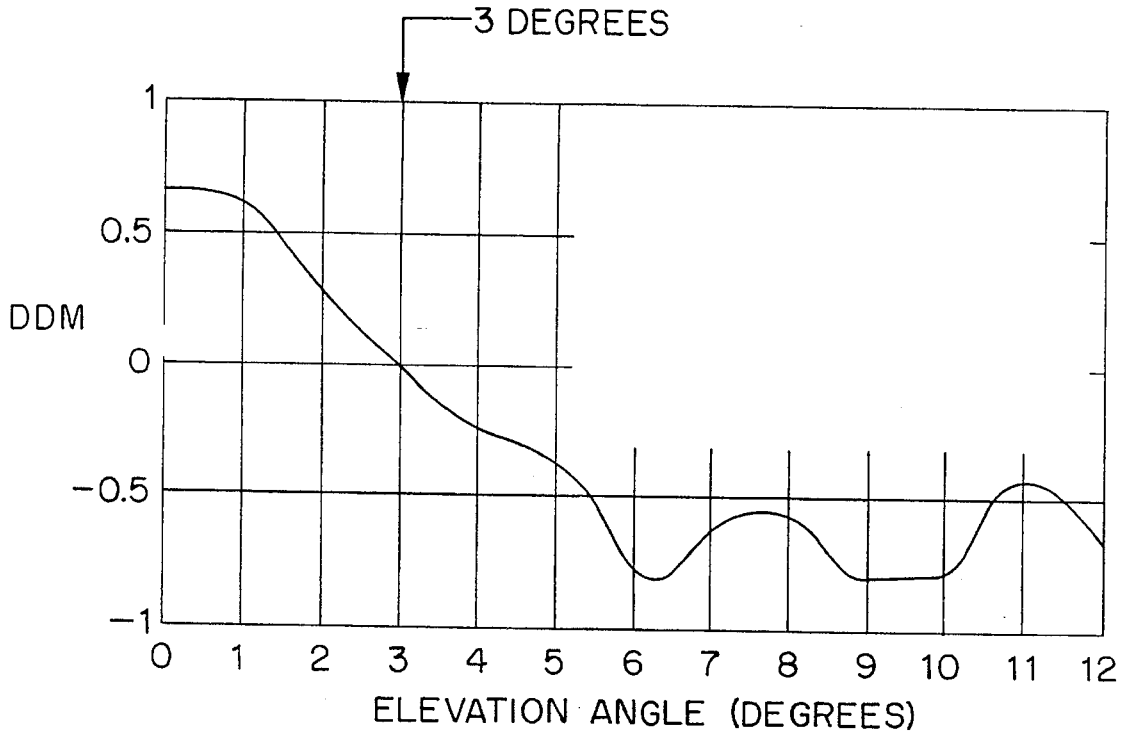

The required value of A is determined to be 0.76. FIG. 5B shows a curve representing the computed DDM (as a voltage ratio) versus elevation angle (in degrees). FIG. 5B indicates that the DDM signal format requirements are satisfied by the antenna system as described.

Figure 6A:
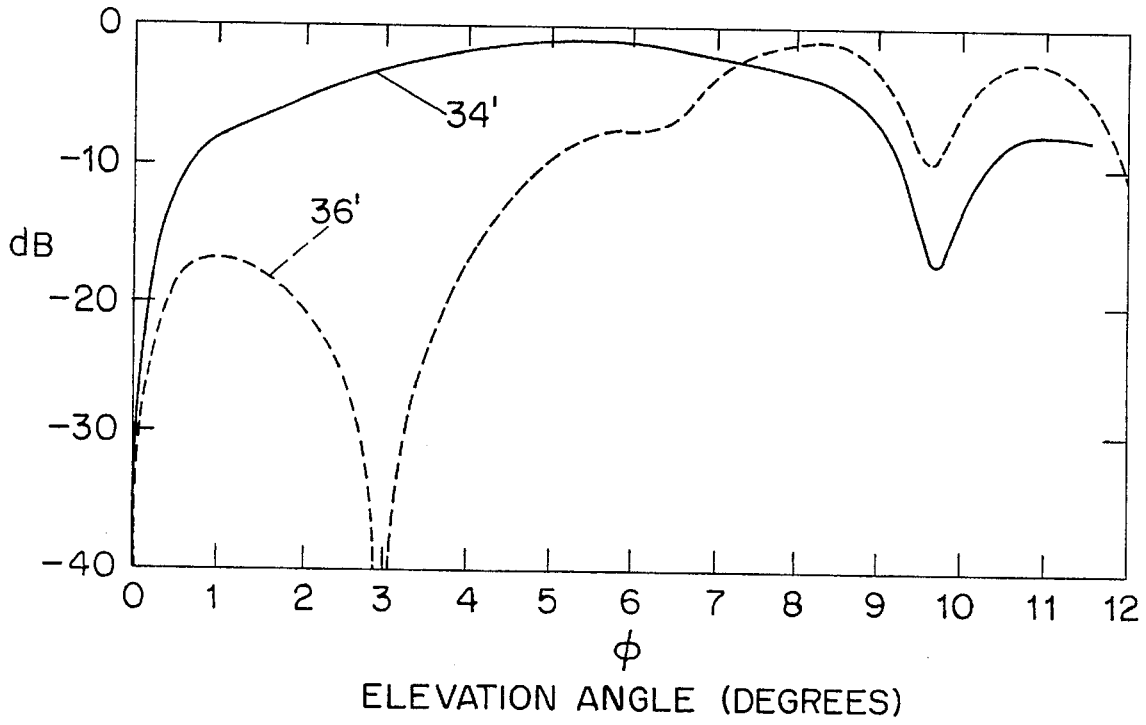
FIGS. 6A and 6B correspond to FIGS. 5A and 5B with effects of an 18 inch snow cover.
Figure 6B:
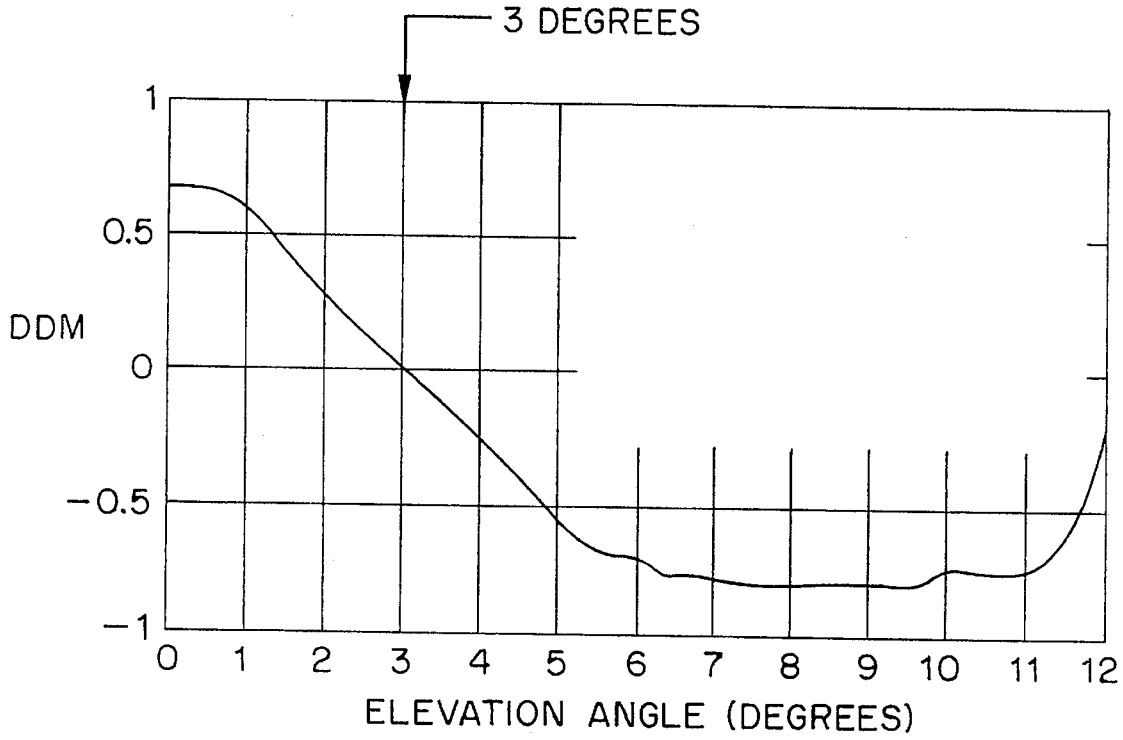

The performance of the FIG. 2 antenna system configuration operating in the presence of an 18 inch snow cover is represented in FIGS. 6A and 6B. FIG. 6A shows the sum pattern 34' and the difference pattern 36' for the antenna installed above an earth with a relative dielectric constant of 20 and a loss tangent of 0.1, and with an 18 inch layer of snow with a relative dielectric constant of 1.23 and a loss tangent of 0.001. This snow situation is known to substantially degrade the performance of existing ILS image type glide path antennas. FIG. 6B shows the computed DDM versus elevation angle and indicates that the DDM characteristics are not degraded by the presence of the snow cover.

Figure 7:
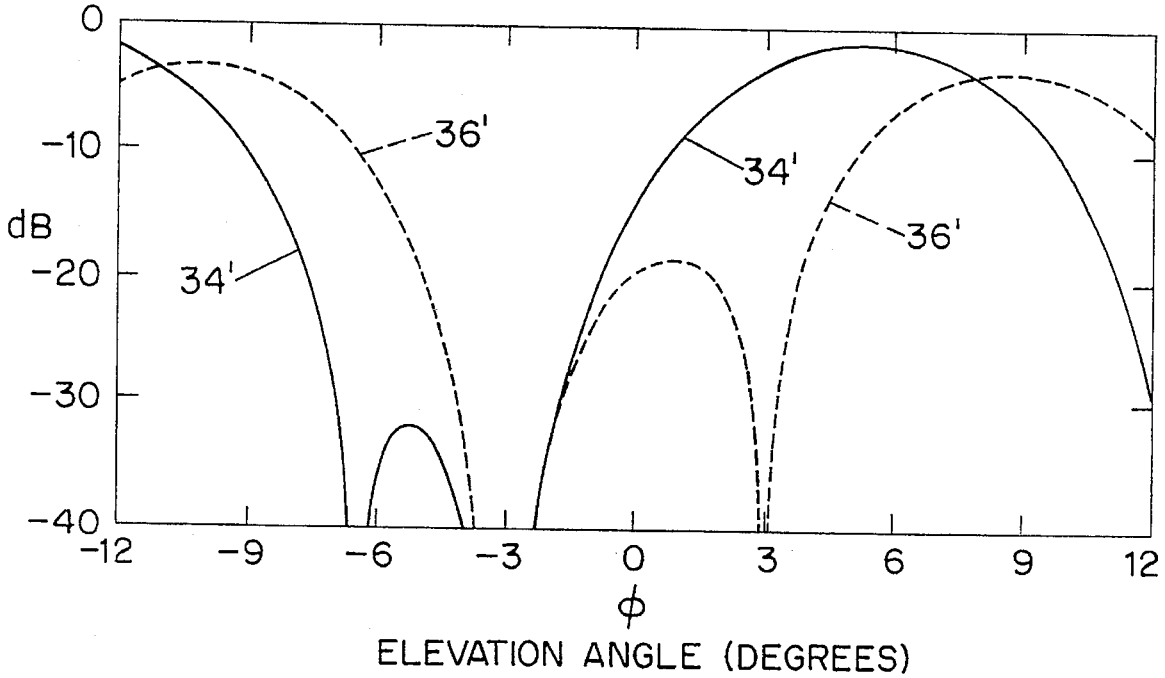
FIG. 7 is a representation of composite free space sum and difference patterns.

The non-imaging antenna system of FIG. 2 achieves the property of providing the described spatial filter null effect in the −3 degree direction independently of the vertical spacing between radiating elements 11–14 and of the overall height of the antenna assembly 10. As already discussed, FIG. 3 represents the free space radiation pattern of each of arrays 11–13 and 12–14, independently, clearly illustrating the null at −3 degrees. Thus, FIG. 3 represents the respective free space patterns as provided with reference to first and second feed ports 22 and 24 in FIG. 2. For further understanding of the providing of the installed radiation pattern of FIG. 5A, attention is directed to FIG. 7. In FIG. 7 are shown the composite free space sum and difference patterns 34' and 36', respectively, as provided with reference to sum and difference input ports 34 and 36 in FIG. 2. The free space composite patterns 34' and 36' in FIG. 7 represent the product of the FIG. 3 array radiation patterns and the sum and difference characteristics of the magic-T junction 32*a*. It is noted that the difference pattern has a null at +3 degrees (in addition to each pattern having a null at −3 degrees). On an installed basis, taking into account reflective effects, the FIG. 7 free space patterns result in the FIG. 5A installed antenna patterns already discussed. It should be noted that the FIG. 7 patterns provided in accordance with the invention result in glideslope guidance signals characterized by about 6 dB less gain than a typical prior type of imaging ILS antenna. However, the lower gain is readily compensated by higher input power and thus is not a matter of significant concern. The gain differential is outweighed by the operational benefits of the invention as described.

Other Configurations

Existing types of ILS imaging antennas inherently provide conical guidance signals as a result of the aircraft approach path not being perpendicular to the electrical aperture of the antenna array. An effect of the conical nature of the guidance signal is to cause the aircraft to depart upward from a straight line glide path as the aircraft is in the final stages of landing. Ideally, the approach path should be a straight line.

Figure 8A:
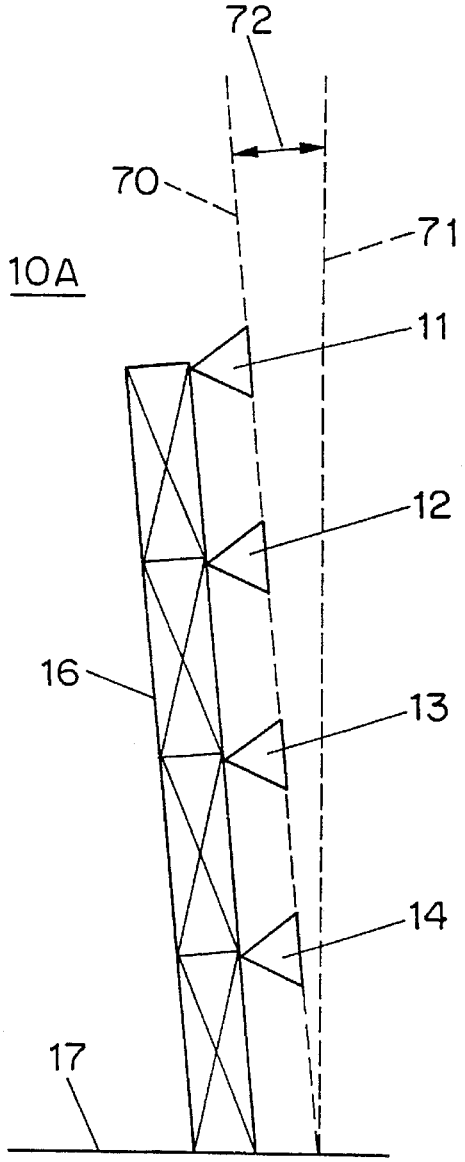
FIGS. 8A and 8B show support structures effective to position the radiating element apertures along an axis tilted from the vertical.
Figure 8B:
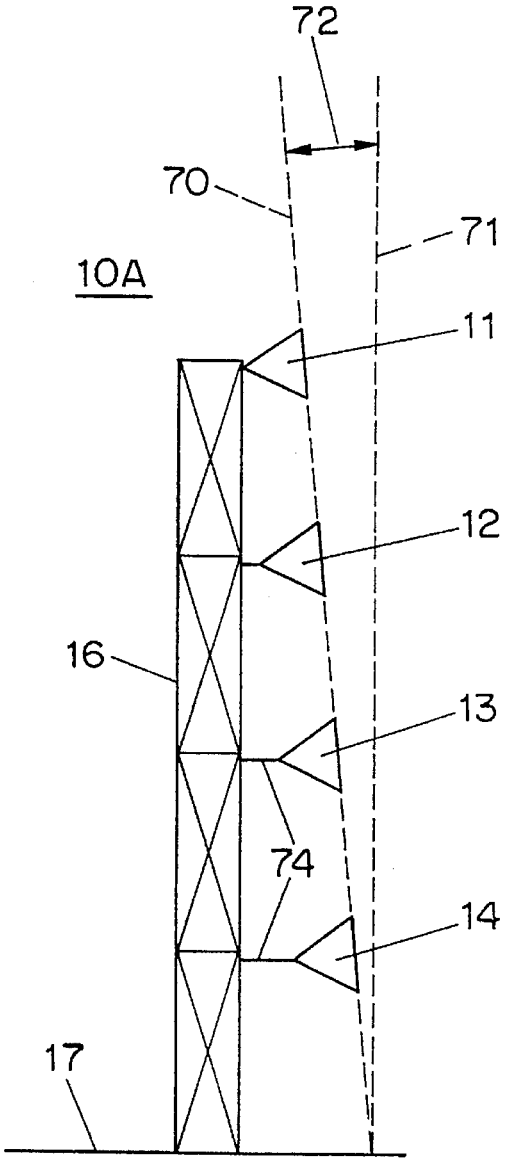

With reference now to FIGS. 8A and 8B, there are illustrated two forms of antenna support structure 10A employable to avoid such conical effect and provide the desired straight line approach path. In each of FIGS. 8A and 8B the support structure is arranged to position the first (elements 11–13) and second (elements 12–14) vertical arrays in tilted relationship along an axis 70 which is tilted relative to a vertical line 71 normal to the horizontal reference/earth 17. In FIG. 8A the support structure comprises a support tower 16 which is tilted from the vertical line 71 by an angle 72 nominally equal to the desired positive angle of the glideslope signal (e.g., the beam center line approach path). As represented in FIG. 8A by axis 70, this results in the radiating elements being positioned so that their electrical apertures fall nominally along axis 70. In FIG. 8B the support structure comprises a vertical support tower 16 and radiating element supports, such as shown at 74. As shown, supports 74 are arranged to position the radiating elements 11–14 in tilted orientation, at different spacings relative to the tower 16, so that their electrical apertures again fall along axis 70, which is tilted from vertical by angle 72. With angle 72 selected to be equal to the positive angle of the glideslope signal (i.e., angle 72 equals 3 degrees for a +3 degree glideslope), an aircraft properly approaching a runway on the glide path will approach antenna system 10A perpendicularly to aperture axis 70. With this relationship, the effects of coning inherent in use of prior types of ILS antennas are avoided and a straight line path to the runway threshold is provided.

For use with the antenna system configurations of FIGS. 8A and 8B certain adjustments are desirably made to the circuit values utilized in the signal distribution network 20 shown in FIG. 2. Thus, by application of the relationships provided above, to provide a glideslope perpendicular to the electrical aperture axis 70, phase delay units 50 in FIG. 2 are arranged to each provide a nominal phase delay value of 67.1 degrees and phase delay unit 52 can be arranged to provide a nominal 0 degree phase degree value. Unit 52 can thus be omitted or used for final performance adjustment purposes in tilted aperture axis configurations of the invention. It should be noted that coning effects in prior types of imaging ILS antennas cannot be cured by tilting, because tilting would be destructive of the reflective symmetry required for proper combination of the direct and reflected radiation as discussed above.

Figure 9:
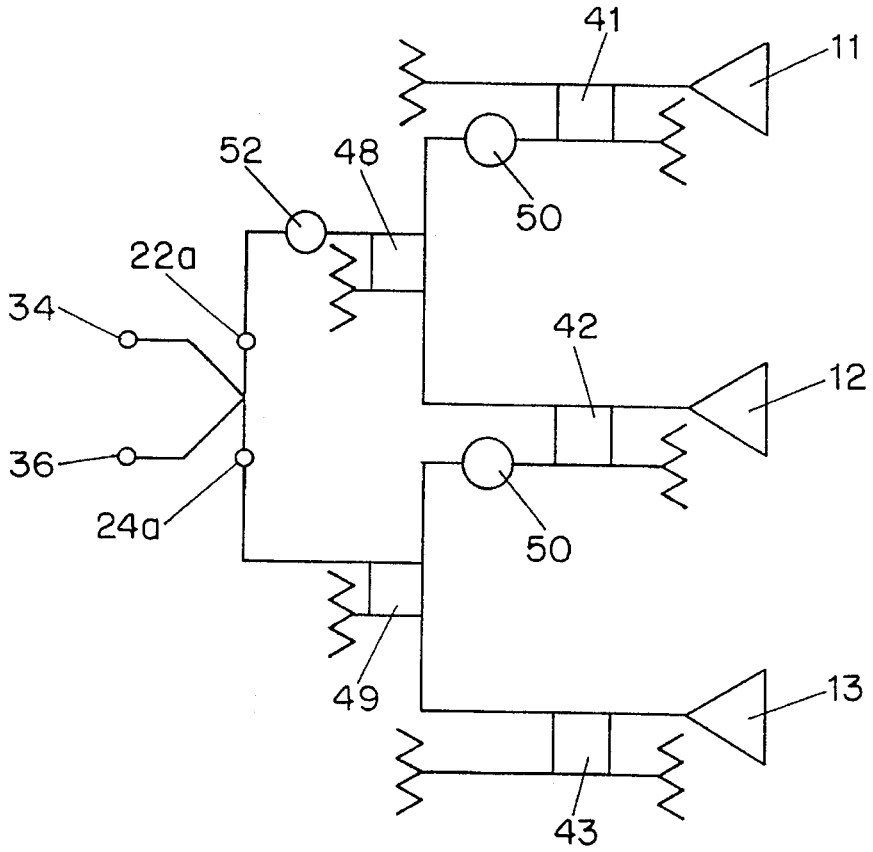
FIG. 9 shows details of an embodiment of the invention utilizing two overlapping arrays of two elements each.
Figure 10:
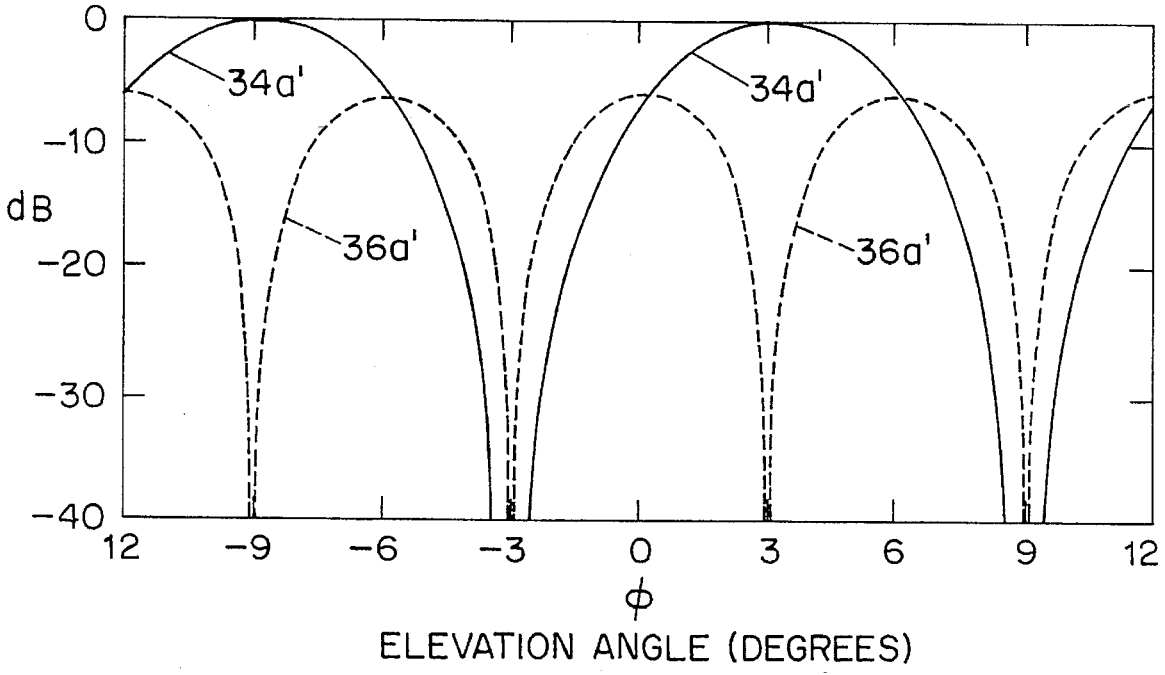
FIG. 10 shows sum and difference patterns for the embodiment of FIG. 9.
Figure 11:
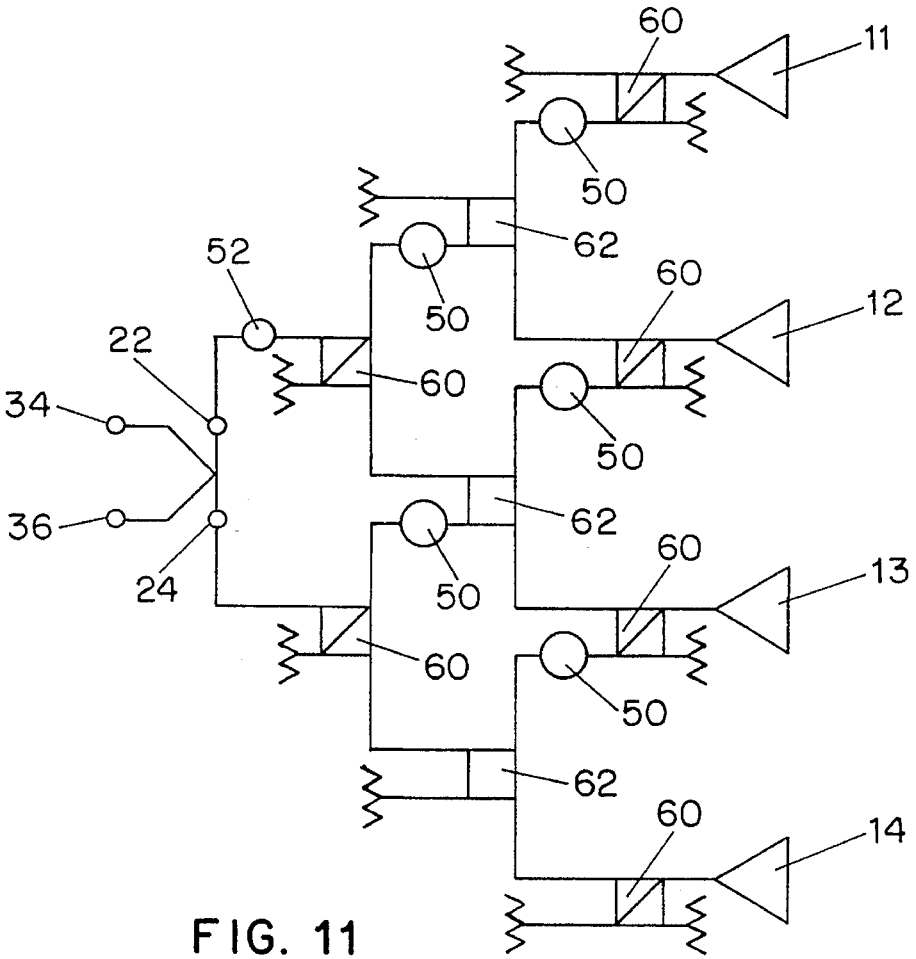
FIG. 11 shows details of an alternative embodiment of a four radiating element antenna system in accordance with the invention.

The null effect achieved by the FIG. 2 system, which incorporates four vertically arrayed radiating elements, is a second order null. A higher order null can be achieved in application of the invention by use of more than four vertically arrayed radiating elements. For example, a five element array would enable a third-order null to be provided at −3 degrees, however, for most applications little additional benefit is obtained with more than four elements. A configuration of the invention utilizing only three radiating elements fed via first and second feed ports 22*a* and 24*a* is shown in FIG. 9. For this configuration the spacing between the radiating elements 11, 12 and 13 is increased to 14.1 feet in a typical design. FIG. 10 is a representation of the sum pattern 34*a*' and the difference pattern 36*a*' provided by the FIG. 9 antenna system configuration. The overall spatial filter null properties of this arrangement in the area of −3 degrees is less effective than previously described for the FIG. 2 antenna system. A further configuration is shown in FIG. 11. The signal distribution network in this embodiment utilizes a spatial filter approach described in the present inventor's earlier U.S. Pat. No. 4,876,548, issued on Oct. 24, 1989, entitled "Phased Array Antenna with Couplers in Spatial Filter Arrangement", which is hereby incorporated by reference. The spatial filter approach of the earlier patent was applied in the context of multi-element phased array antenna feeds of Microwave Landing System (MLS) antennas and does not disclose or suggest the operative effects achievable by use of the present invention, particularly the pattern product results achievable by utilization of an input unit such as a magic-T junction with a spatial filter arrangement. In FIG. 11 the spatial filter consists of three levels of couplers. Couplers 60 are 8.3 dB directional couplers and couplers 62 are 3 dB directional couplers. The free space sum and difference patterns for a non-imaging antenna system configured as in FIG. 11 are the same as those previously described for the FIG. 2 configuration. The FIG. 11 antenna system configuration requires fewer components than the FIG. 2 system, however, the FIG. 2 system uses only one type of directional coupler and operationally has a more robust null effect in the –3 degree direction. Therefore, while both the FIG. 3 and the FIG. 11 configurations of non-imaging antenna systems in accordance with the invention provide important operating advantages as compared to prior ILS glideslope antennas, FIG. 3 represents the presently preferred embodiment.

While there have been described the currently preferred embodiments of the invention, those skilled in the art will recognize that other and further modifications may be made without departing from the invention and it is intended to claim all modifications and variations as fall within the scope of the invention.

What is claimed is:

1. A non-imaging glideslope antenna system, to provide an aircraft guidance glideslope signal at a positive angle and a low signal effect at a negative angle relative to a horizontal reference, comprising:

a plurality of radiating elements arranged for use in overlapping first and second vertical arrays, said plurality consisting of four radiating elements, said first vertical array consisting of the upper three radiating elements and said second vertical array consisting of the lower three radiating elements, with two of said radiating elements common to each vertical array;

a signal distribution network, coupled between first and second feed ports and said radiating elements, said network comprising a first group of four directional couplers, individually connected to said radiating elements;

a second group of three directional couplers, individually connected between adjacent pairs of directional couplers of said first group;

a third group of two directional couplers, individually connected between adjacent pairs of directional couplers of said second group and each also connected to one of said first and second feed ports, and said network thereby arranged:

(A) to couple an upper array glideslope signal from said first feed port to the radiating elements of said first vertical array with signal amplitudes and phases effective to provide said low signal effect at said negative angle; and (B) to couple a lower array glideslope signal from said second feed port to the radiating elements of said second vertical array with signal amplitudes and phases effective to provide said low signal effect at said negative angle; and a signal input unit coupled to said first and second feed ports, and arranged to provide said upper array glideslope signal to said first feed port and said lower array glideslope signal to said second feed port.

2. A non-imaging glideslope antenna system as in claim 1, wherein said signal input unit comprises a junction device, having sum and difference input ports, and having first and second output ports coupled to said first and second feed ports.

3. A non-imaging glideslope antenna system as in claim 2, wherein said junction device is arranged to provide said upper array and lower array glideslope signals in response to carrier and sideband signals supplied to said sum input port and sideband signals supplied to said difference input port.

4. A non-imaging glideslope antenna system as in claim 3, additionally comprising a signal supply unit arranged to supply said carrier and sideband signals to said sum input port and said sideband signals to said difference input port.

5. A non-imaging glideslope antenna system as in claim 1, wherein said signal distribution network is arranged to couple said upper array glideslope signal to said upper three radiating elements with relative amplitudes of one-quarter, one-half and one-quarter respectively and relative phases effective to provide said low signal effect at said negative angle.

6. A non-imaging glideslope antenna system as in claim 5, wherein said relative phases are nominally 0 degrees phase for the lower radiating element, nominally 123.5 degrees phase delay for the middle radiating element, and nominally 247 degrees phase delay for the upper radiating element of each of said first and second vertical arrays.

7. A non-imaging glideslope antenna system as in claim 1, additionally including a plurality of phase shift means, individual ones of which are coupled at an input to each of three adjacent directional couplers of said first group and at an input to each of two adjacent directional couplers of said second group, for providing different relative phases effective to provide said low signal effect at said negative angle.

8. A non-imaging glideslope antenna system as in claim 7, additionally including phase shift means, coupled to said first feed port, for determining said positive angle of said glideslope signal.

9. A non-imaging glideslope antenna system as in claim 1, additionally comprising a support structure arranged to position said first and second vertical arrays in tilted relationship to a vertical line normal to said horizontal reference.

10. A non-imaging glideslope antenna system as in claim 9, wherein said support structure comprises a support tower tilted from said vertical line by an angle nominally equal to said positive angle of the glideslope signal.

11. A non-imaging glideslope antenna system as in claim 9, wherein said support structure comprises a support tower extending nominally normal to said horizontal reference and radiating element supports arranged to position said radiating elements so that their electrical apertures fall nominally along an axis tilted from said vertical line by an angle equal to said positive angle of the glideslope signal.

12. A non-imaging glideslope antenna system as in claim 1, wherein each said radiating element comprises a plurality of dipoles arrayed horizontally in front of a corner reflector.

13. A non-imaging glideslope antenna system as in claim 1, wherein-said antenna system is an ILS antenna system, said positive angle is plus 3 degrees elevation and said negative angle is minus 3 degrees elevation.

14. A non-imaging glideslope antenna system as in claim 1, additionally including phase shift means, coupled to said first feed port, for determining said positive angle of said glideslope signal.

15. A non-imaging glideslope antenna system as in claim 1, additionally including an integral antenna performance monitor comprising four sampling directional couplers, each coupled to the signal input to one of said radiating elements, and means for combining signals from said sampling directional couplers to provide a representation of the far field signal produced by said antenna system.

16. A non-imaging antenna system, to provide a main radiated signal at a positive angle and a low signal effect at a negative angle relative to a horizontal reference, comprising:

a plurality of radiating elements arranged for use in overlapping first and second vertical arrays, said plurality consisting of four radiating elements, said first vertical array consisting of the upper three radiating elements and said second vertical array consisting of the lower three radiating elements, with two of said radiating elements common to each vertical array;

a signal distribution network coupled between first and second feed ports and said radiating elements, said network comprising a first group of four directional couplers, individually connected to said radiating elements;

a second group of three directional couplers, individually connected between adjacent pairs of directional couplers of said first group; and a third group of two directional couplers, individually connected between adjacent pairs of directional couplers of said second group and each also connected to one of said first and second feed ports, and said network thereby arranged:

(A) to couple an upper array signal from said first feed port to the radiating elements of said first vertical array with signal amplitudes and phases effective to provide said low signal effect at said negative angle; and (B) to couple a lower array signal from said second feed port to the radiating elements of said second vertical array with signal amplitudes and phases effective to provide said low signal effect at said negative angle; and a signal input unit including a junction device having sum and difference input ports and first and second output ports coupled to said first and second feed ports, respectively.

17. A non-imaging antenna system as in claim 16, additionally including a plurality of phase shift means, individual ones of which are coupled at an input to each of three adjacent directional couplers of said first group and at an input to each of two adjacent directional couplers of said second group, for providing different relative phases effective to provide said low signal effect at said negative angle.

18. A non-imaging antenna system as in claim 16, additionally comprising a support structure arranged to support said first and second vertical arrays in tilted relationship so that the electrical apertures of said radiating elements fall nominally along an axis tilted from a vertical line normal to said horizontal reference.

19. A non-imaging antenna system as in claim 16, wherein each said radiating element comprises a plurality of dipoles arrayed horizontally in front of a corner reflector.

20. A non-imaging antenna system, to provide a main radiated signal at a positive angle and a low signal effect at a negative angle relative to a horizontal reference, comprising:

a plurality of radiating elements arranged for use in overlapping first and second vertical arrays, said plurality consisting of three radiating elements, said first vertical array consisting of the upper two radiating elements and said second vertical array consisting of the lower two radiating elements, with one of said radiating elements common to each vertical array;

a signal distribution network coupled between first and second feed ports and said radiating elements, said network comprising a first group of three directional couplers, individually coupled to said radiating elements; and a second group of two directional couplers, individually coupled between adjacent pairs of directional couplers of said first group and each also connected to one of said first and second feed ports, and said network thereby arranged:

(A) to couple an upper array signal from said first feed port to the radiating elements of said first vertical array with signal amplitudes and phases effective to provide said low signal effect at said negative angle; and (B) to couple a lower array signal from said second feed port to the radiating elements of said second vertical array with signal amplitudes and phases effective to provide said low signal effect at said negative angle; and a signal input unit including a junction device having sum and difference input ports and first and second output ports coupled to said first and second feed ports, respectively.

21. A non-imaging antenna system as in claim 20, additionally including a plurality of phase shift means, individual ones of which are coupled at an input to each of two adjacent directional couplers of said first group and at an input to one directional coupler of said second group, for providing different relative phases effective to provide said low signal effect at said negative angle.

22. A non-imaging antenna system as in claim 20, additionally comprising a support structure arranged to support said first and second vertical arrays in tilted relationship so that the electrical apertures of said radiating elements fall nominally along an axis tilted from a vertical line normal to said horizontal reference.

23. A non-imaging antenna system as in claim 20, wherein each said radiating element comprises a plurality of dipoles arrayed horizontally in front of a corner reflector.

* * * * *